US007497758B2

(12) United States Patent
Hamasaki

(10) Patent No.: US 7,497,758 B2
(45) Date of Patent: Mar. 3, 2009

(54) TOY BOAT

(75) Inventor: Takashi Hamasaki, Kanagawa (JP)

(73) Assignee: Kyosho Corporation, Tokyo (JP)

( * ) Notice: Subject to any disclaimer, the term of this patent is extended or adjusted under 35 U.S.C. 154(b) by 355 days.

(21) Appl. No.: 11/314,818

(22) Filed: Dec. 22, 2005

(65) Prior Publication Data

US 2006/0183400 A1 Aug. 17, 2006

(30) Foreign Application Priority Data

Dec. 28, 2004 (JP) ..... 2004-378993

(51) Int. Cl.
*A63H 23/02* (2006.01)
*A63H 23/04* (2006.01)

(52) U.S. Cl. ..... 446/160; 446/165

(58) Field of Classification Search ..... 446/160–165; 440/49–51, 53, 111
See application file for complete search history.

(56) References Cited

U.S. PATENT DOCUMENTS

| | | | | | |
|---|---|---|---|---|---|
| 2,702,173 | A | * | 2/1955 | Young | 248/643 |
| 2,814,906 | A | * | 12/1957 | Orvis | 446/165 |
| 2,956,536 | A | * | 10/1960 | Kilvington | 440/59 |
| 3,465,706 | A | * | 9/1969 | Gwidt | 440/49 |
| 3,528,195 | A | * | 9/1970 | Cooper | 446/165 |
| 3,629,680 | A | | 12/1971 | Baynes et al. | |
| 3,714,919 | A | * | 2/1973 | Ernst | 440/6 |
| 3,736,699 | A | * | 6/1973 | Nielsen | 446/165 |
| 3,958,525 | A | | 5/1976 | Luthman | |
| 4,048,751 | A | * | 9/1977 | Muller-Seidel et al. | 446/154 |
| 4,334,872 | A | * | 6/1982 | Gaston | 440/61 R |
| 5,037,337 | A | * | 8/1991 | Richter | 440/57 |
| 5,377,439 | A | * | 1/1995 | Roos et al. | 43/3 |
| 5,429,383 | A | | 7/1995 | Reed | |
| 6,026,759 | A | * | 2/2000 | Hazelett et al. | 114/144 E |
| 6,468,127 | B1 | | 10/2002 | Lee | |
| 6,482,057 | B1 | * | 11/2002 | Schoell | 440/53 |
| 6,690,622 | B1 | | 2/2004 | Eckberg, Sr. et al. | |
| 2006/0141897 | A1 | | 6/2006 | Hamasaki | |
| 2006/0141901 | A1 | | 6/2006 | Hamasaki | |

FOREIGN PATENT DOCUMENTS

| | | |
|---|---|---|
| JP | S-58-179192 | 11/1983 |

* cited by examiner

*Primary Examiner*—Eugene Kim
*Assistant Examiner*—Alyssa M Hylinski
(74) *Attorney, Agent, or Firm*—Nixon & Vanderhye P.C.

(57) ABSTRACT

A toy boat includes a screw 29 driven by a driving source 26, a screw bracket 30 configured to support the screw 29 and function as a rudder, and a servo mechanism 31 configured to turn the screw bracket 30 towards a horizontal position. The driving source 26 is mounted on the inner side of a boat body 22. The screw 29 is connected to a drive shaft 27 by a universal joint 28 on the outer side of the boat body 22, wherein the drive shaft 27 is driven by the driving source 26. A screw adjustment mechanism 38 configured to adjust the angle and depth of the screw 29 is provided, wherein the adjustment is centered around a connection part 28*a* connecting the universal joint 28 and the drive shaft 27.

5 Claims, 14 Drawing Sheets

TOY BOAT

BACKGROUND OF THE INVENTION

1. Field of the Invention

The present invention relates to a toy boat configured to drive a screw by a driving source and turn a screw that supports the screw and function as a rudder towards a horizontal position by a servo mechanism.

2. Description of the Related Art

A known toy boat includes a wire shaft configured to connect a driving source and a screw and a screw adjustment mechanism that adjusts the angle and depth of the screw and is fixed by tilting the screw that also functions as a rudder vertically.

For reference, refer to Japanese Unexamined Utility Model Registration Application Publication No. 58-179192.

SUMMARY OF THE INVENTION

Since the screw adjustment mechanism is fixed by tilting the screw that also functions as a rudder vertically, the angle and depth of the screw can be finely adjusted in accordance with the condition of the waves or any preference.

The prevent invention solves the above-identified problems by providing a toy boat that is capable of finely and easily adjusting the angle and depth of a screw in accordance with the condition of the waves or any preference. Accordingly, the toy boat is capable of being moved in various conditions.

A toy boat including a screw driven by a driving source, a screw bracket configured to support the screw and function as a rudder, and a servo mechanism configured to turn the screw bracket towards a horizontal position, wherein the driving source is mounted on the inner side of a boat body, the screw is connected to a drive shaft by a universal joint on the outer side of the boat body, wherein the drive shaft is driven by the driving source, and a screw adjustment mechanism configured to adjust the angle and depth of the screw is provided, wherein the adjustment is centered around a connection part 28*a* connecting the universal joint 28 and the drive shaft.

As a second aspect of the present invention, the electric motor toy transport trailer according to the first aspect of the present invention may include a first fixing bracket having a first arc-shaped groove, wherein the first fixing bracket is centered around the connection part and attached to the boat body so that the first fixing bracket is turnable towards a horizontal position, a second fixing bracket having a second arc-shaped groove, wherein the second fixing bracket is centered around the connection part while opposing the first arc-shaped groove and attached to the first fixing bracket, and a screw bracket having a protrusion interposed and fixed between the first fixing bracket and the second fixing bracket, wherein the screw bracket is centered around the connection part and is provided in the first and second arc-shaped grooves so that the screw bracket is movable along the first and second arc-shaped grooves.

As a third aspect of the present invention, the electric motor toy transport trailer according to the second aspect of the present invention may include the screw adjustment mechanism including the servo mechanism turnable towards a horizontal position on the outer side of the boat body. The screw adjustment mechanism may include a first fixing bracket having a first arc-shaped groove being centered around the connection part, wherein the upper edge of the first fixing bracket is mounted on a housing of the servo mechanism, a second fixing bracket having a second arc-shaped groove being centered around the connection part and opposing the first arc-shaped groove, wherein the second fixing bracket is attached to the first fixing bracket, and a screw bracket having a protrusion interposed and fixed between the first fixing bracket and the second fixing bracket, wherein the screw bracket is centered around the connection part and is provided in the second arc-shaped groove so that the screw bracket is movable along the first and second arc-shaped grooves.

As a fourth aspect of the present invention, the electric motor toy transport trailer according to one of the second and third aspect of the present invention may include a plurality of protrusions on screw bracket 30.

According to the present invention, the driving source is mounted on the inner side of the boat body, the screw is connected to the driving shaft, which is driven by the electric motor, with the universal joint at the outside of the boat body. Then, the screw adjustment mechanism configured to adjust the angle of the screw by pivoting the screw around the connecting part connecting the hexagonal universal joint and the driving shaft. The screw adjustment mechanism 38 includes a first fixing bracket having a first arc-shaped groove, wherein the first fixing bracket is centered around the connection part and attached to the boat body so that the first fixing bracket 39 is turnable towards a horizontal position, a second fixing bracket having a second arc-shaped groove, wherein the second fixing bracket is centered around the connection part while opposing the first arc-shaped groove and being attached to the first fixing bracket, and a screw bracket having a protrusion interposed and fixed between the first fixing bracket and the second fixing bracket, wherein the screw bracket is centered around the connection part and is provided in the first and second arc-shaped grooves so that the screw bracket is movable along the first and second arc-shaped grooves. Therefore, the screw bracket can be pivoted around the connecting part within a vertical plane. The angle and depth of screw can be finely and easily adjusted in accordance with the condition of the waves or any preference. Accordingly, the toy boat is capable of being moved in various conditions.

The servo mechanism is mounted on the outer side of the boat body so that the screw bracket can be turned towards a horizontal position, and the screw adjustment mechanism, as shown in FIG. 13, includes a first fixing bracket whose upper edge is attached to the housing of the servo mechanism, a second fixing bracket attached to the first fixing bracket with a fixing screw, and the screw bracket includes the protrusions interposed and fixed between the first and second arc-shaped grooves. Moreover, the first fixing bracket includes a first arc-shaped groove being center around the connecting part, the second fixing bracket includes a second arc-shaped groove being center around the connecting part and opposing the first arc-shaped groove, and the screw bracket can be moved in and along the first and second arc-shaped grooves, wherein the movement is centered around the connecting part. Therefore, the screw bracket can be turned towards a horizontal position by the servo mechanism with the first and second fixing brackets. In this way, a rod configured to transmit power generated at the servo mechanism to the screw bracket for steering and to turn the screw bracket towards a horizontal position is not required. Thus, the steering can be easily adjusted.

Since a plurality of protrusions is provided, the screw bracket can be firmly fixed by the first and second fixing bracket.

DESCRIPTION OF THE PREFERRED EMBODIMENTS

An embodiment of the present invention will be described below with reference to the drawings.

A toy boat 21 according to the embodiment described below is an electric motor toy including an electric motor as a driving source.

First, an electric motor toy transport trailer will be described.

Figure 1:
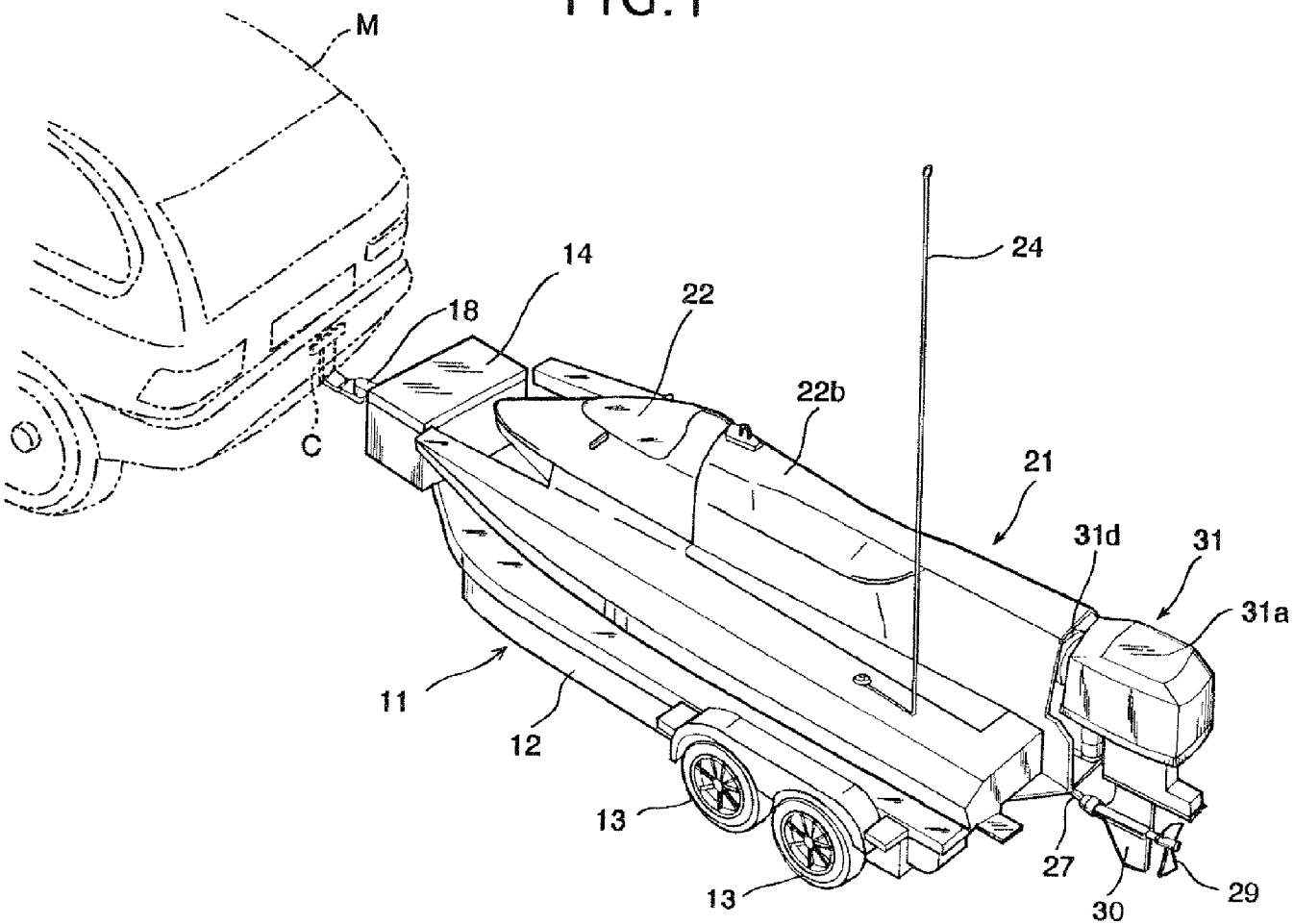
FIG. 1 is a perspective view of a toy boat loaded on an electric motor toy transport trailer that is coupled to a toy automobile with a coupler.
Figure 2:
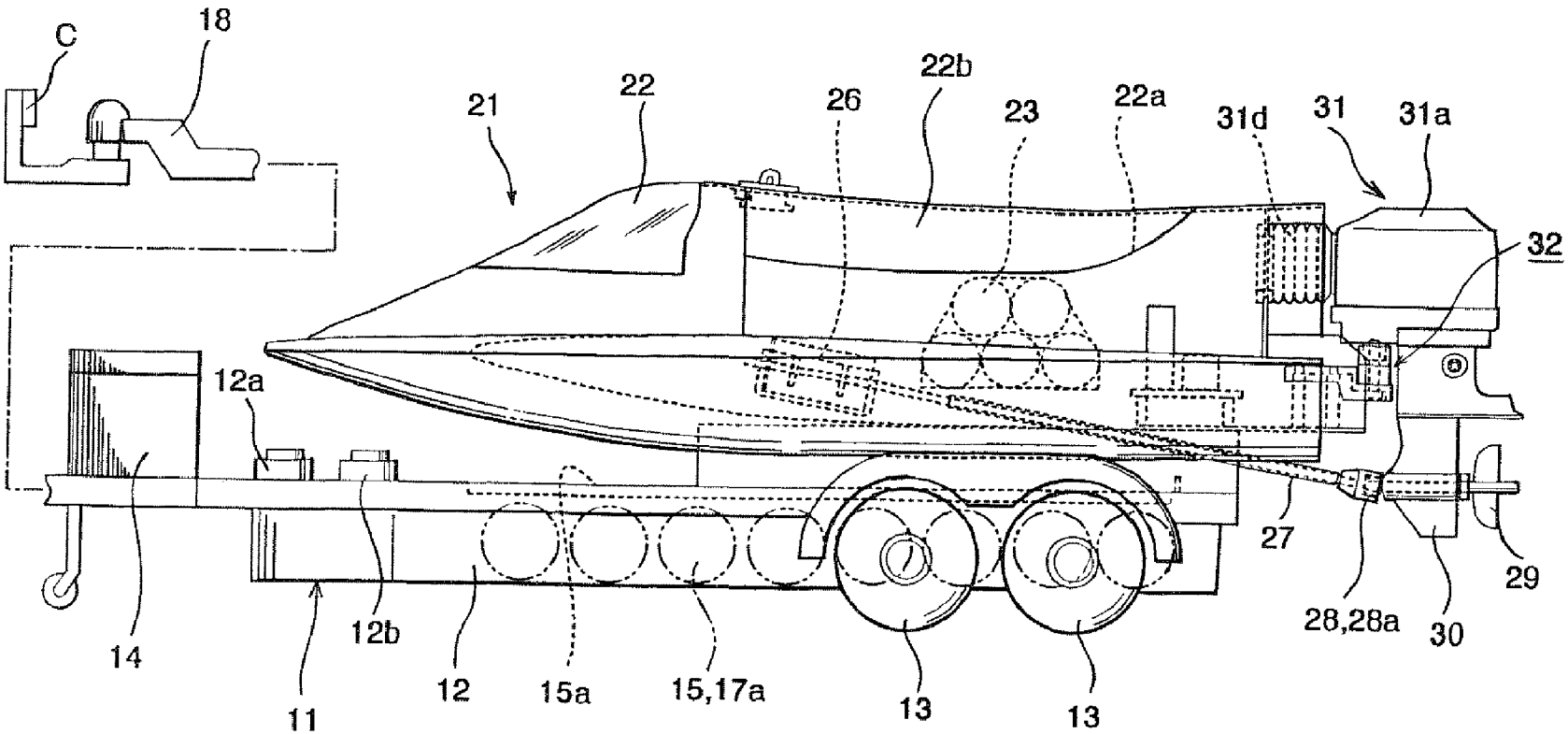
FIG. 2 is a side view of the electric motor toy transport trailer shown in FIG. 1.
Figure 3:
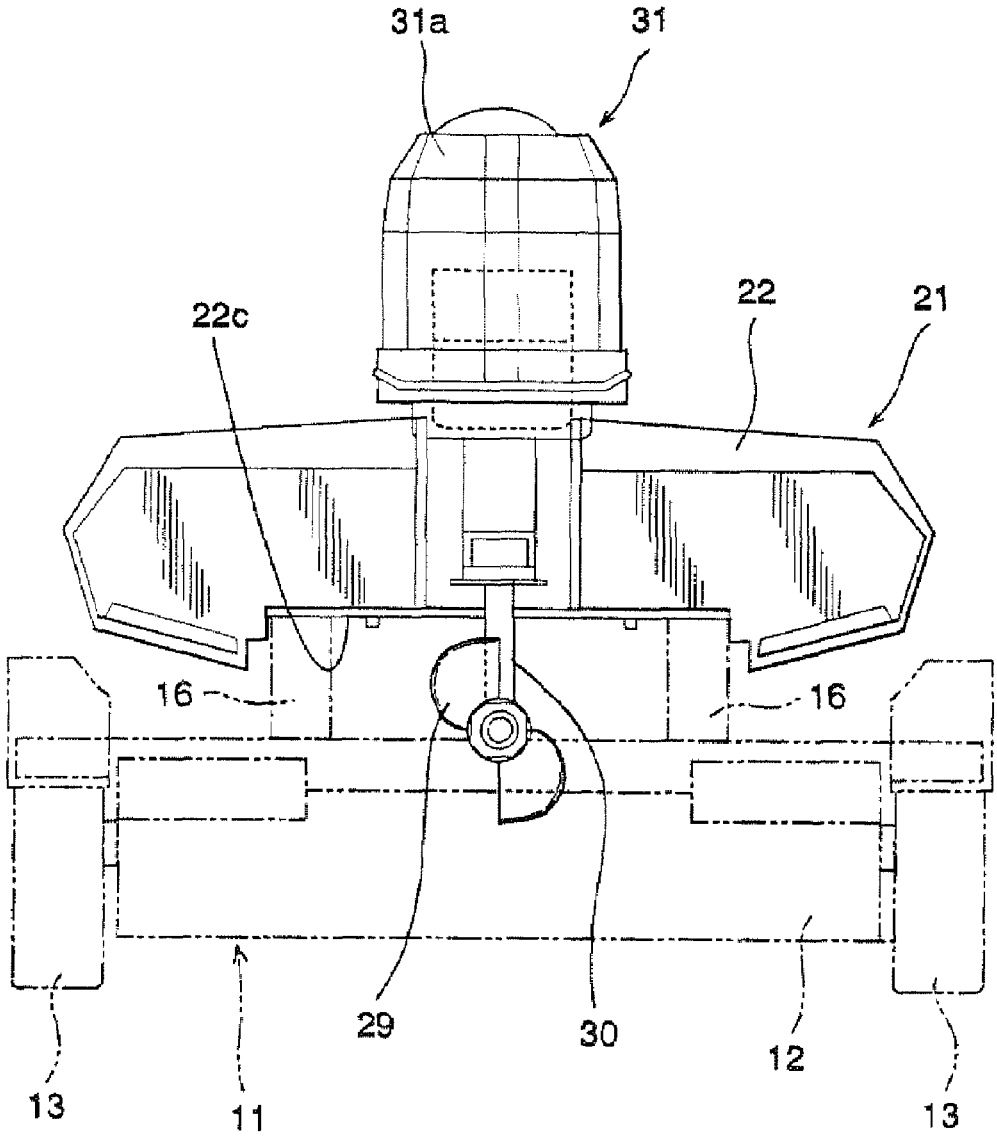
FIG. 3 is a back view of the electric motor toy transport trailer shown in FIG. 1.
Figure 4:
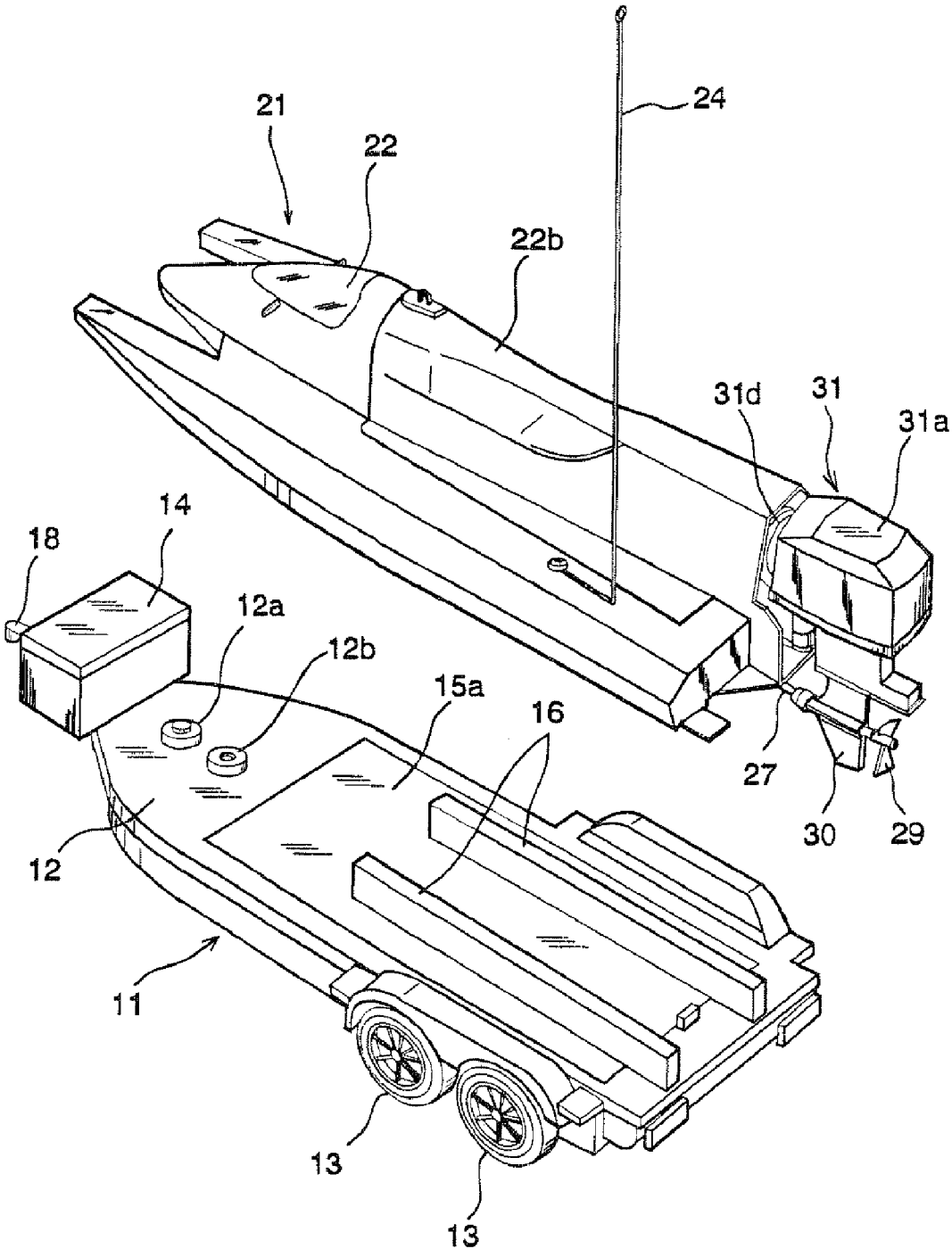
FIG. 4 is a perspective view of a toy boat removed upward from the electric motor toy transport trailer.
Figure 5:
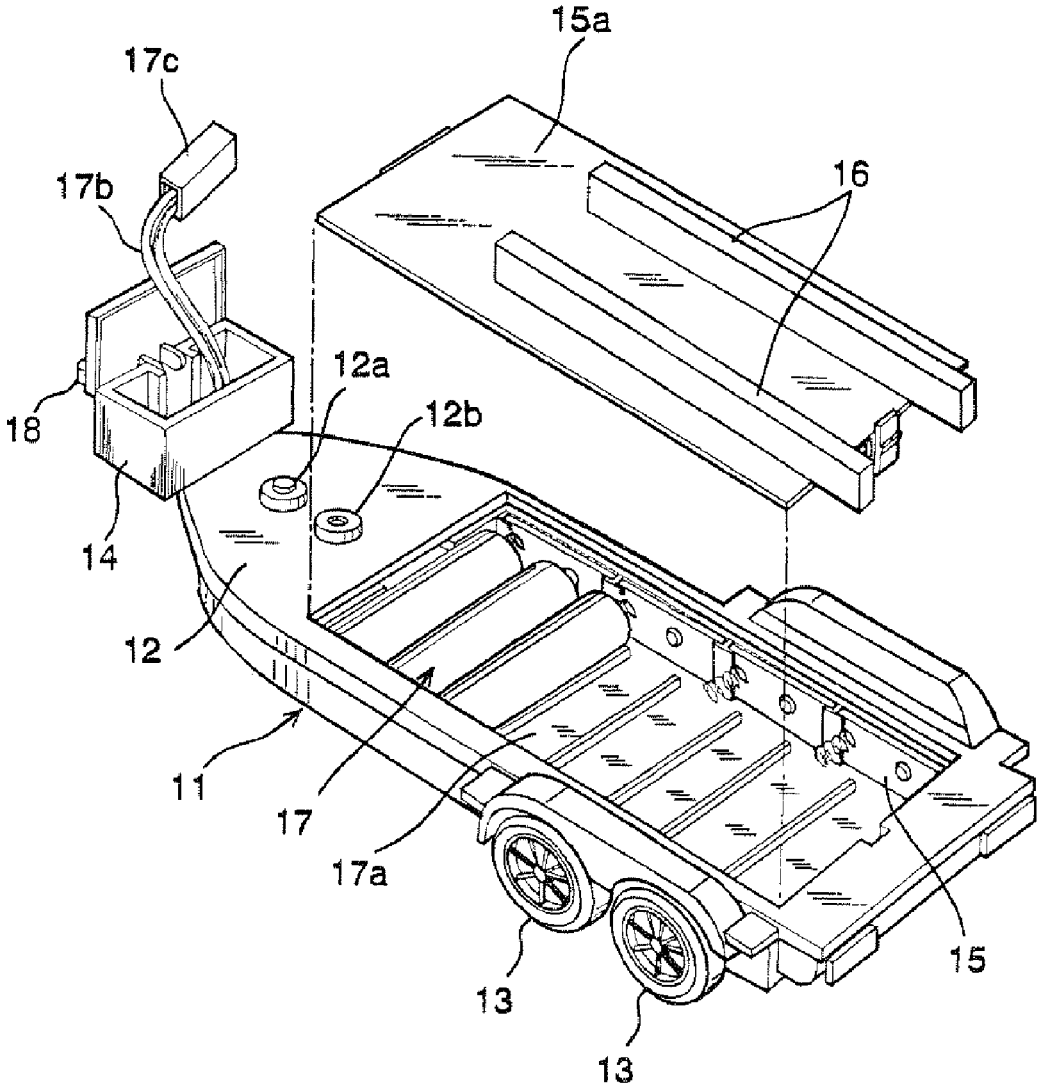
FIG. 5 is a perspective view of a rechargeable main power source container for the electric motor toy transport trailer with the cover of a container box opened.
Figure 6:
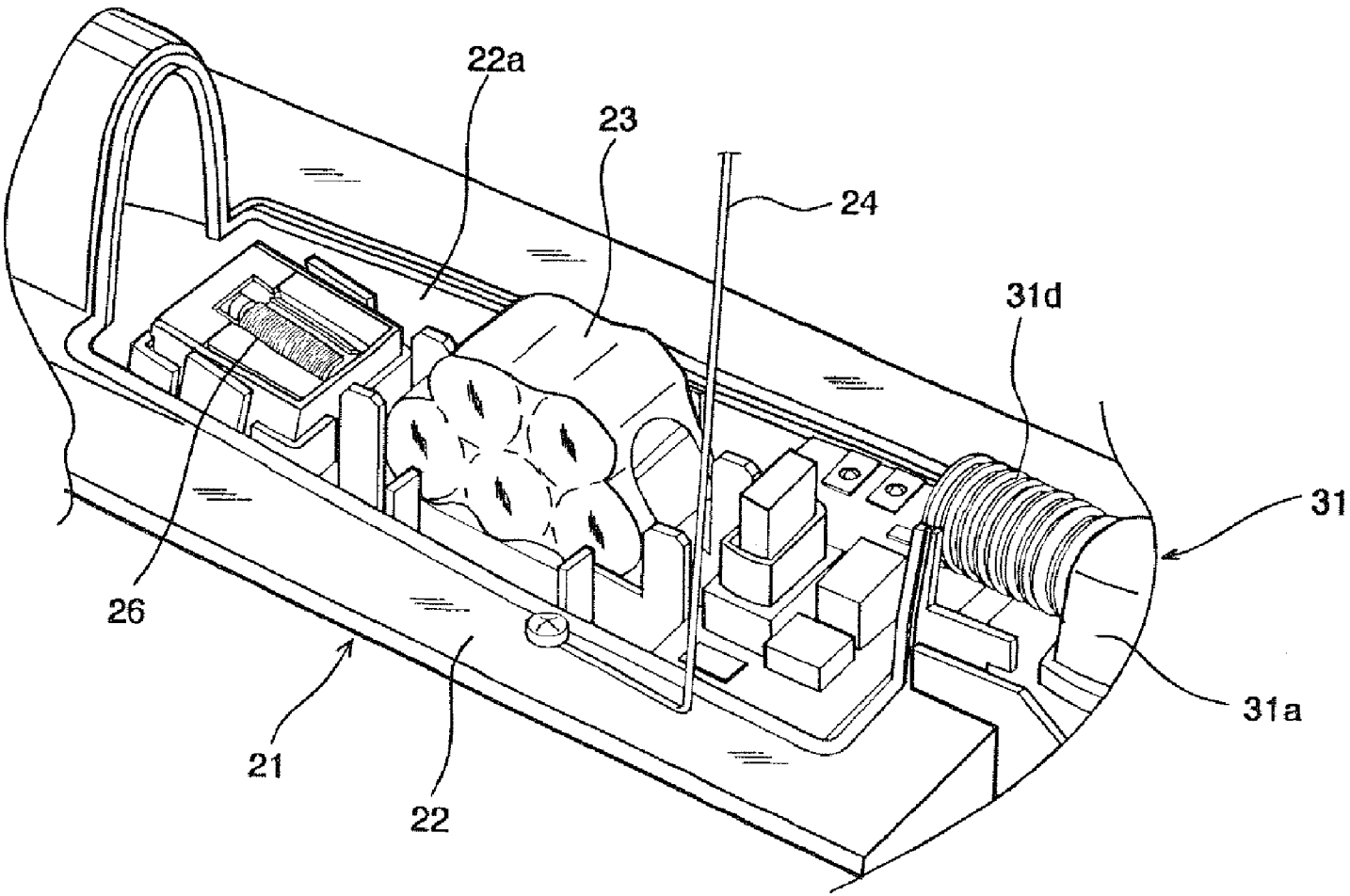
FIG. 6 is a partial perspective view of the toy boat with the cover removed to expose the power source.

FIG. 1 is a perspective view of a toy boat loaded on an electric motor toy transport trailer that is coupled to a toy automobile with a coupler. FIG. 2 is a side view of the electric motor toy transport trailer shown in FIG. 1. FIG. 3 is a back view of the electric motor toy transport trailer shown in FIG. 1. FIG. 4 is a perspective view of a toy boat removed upward from the electric motor toy transport trailer. FIG. 5 is a perspective view of a rechargeable main power source container for the electric motor toy transport trailer with the cover of a container box opened. FIG. 6 is a partial perspective view of the toy boat with the cover removed to expose the power source. In FIG. 3, the electric motor toy transport trailer is illustrated in a changed double-dotted line to so that the toy boat stands out in the drawing.

There drawings illustrates an electric motor toy transport trailer 11 that includes an electric motor toy transport trailer body 12 and a coupler 18 provided on the electric motor toy transport trailer body 12 so as to couple the electric motor toy transport trailer body 12 with a coupler C of a toy automobile M.

Tires 13 are attached to the electric motor toy transport trailer body 12, enabling the electric motor toy transport trailer body 12 to be pulled and moved by the toy automobile M. A container box 14 is provided at the rear part of the couple 18, i.e., the upper portion of the tip of the electric motor toy transport trailer body 12, so that the container box 14 does not interfere with the toy boat 21 loaded on the electric motor toy transport trailer body 12. Also, a rechargeable main power source container 15 with a cover 15*a* configured to contain a rechargeable main power source 17*a* constituting a charger 17 is provided at the center of the electric motor toy transport trailer body 12.

On the upper side of the cover 15*a* of the rechargeable main power source container 15, a plurality of (e.g., two) protrusions 16 having a predetermined height is provided so as to support the toy boat 21 from below. The charger 17 includes a power source (e.g., battery), the rechargeable main power source 17*a* stored in the rechargeable main power source container 15, a cord 17*b* being connected to the rechargeable main power source 17*a* and extending into the container box 14 through the electric motor toy transport trailer body 12, and a charging connector 17*c* being connected to the cord 17*b* and stored in the container box 14. The rechargeable main power source 17*a* is stored in the rechargeable main power source container 15 so that it is positioned below the upper edge of the tires 13.

The inner side of a boat body 22 of the toy boat 21 is a container 22*a*. The container 22*a* stores various components, such as a power source 23 detachable from the container 22*a*. The opening of the container 22*a* is watertightly closed with a cover 22*b*. At the bottom of the boat body 22, a depression 22*c* penetrating through the boat body 22 in the longitudinal direction is provided.

To load the toy boat 21 on the electric motor toy transport trailer 11 having the above-described structure, the depression 22*c* provided in the lower portion of the boat body 22 is aligned with the protrusions 16 of the cover 15*a* in a manner such that the protrusions 16 enter the depression 22*c*, as shown in FIG. 4, so as to support the toy boat 21.

To transport the toy boat 21 with the electric motor toy transport trailer 11, first, the toy boat 21 is loaded on the electric motor toy transport trailer 11, as described above, and, then, the coupler 18 is coupled with the toy automobile M. In this way, the toy boat 21 can transported on the electric motor toy transport trailer 11 by moving the toy automobile M.

To charge the power source 23 of the toy boat 21, as shown in FIG. 6, first, the cover 22*b* is removed to remove the power source 23 from the boat body 22. Then, as shown in FIG. 5, the container box 14 is opened to remove the charging connector 17*c* from the container box 14 and to connect the charging connector 17*c* with the power source 23. Subsequently, a switch 12*a* mounted on the upper surface of the electric motor toy transport trailer body 12 is pushed to illuminate a light-emitting diode 12*b* that indicates the charging of the power source 23 and charge the power source 23. After the charging is completed, the charging connector 17*c* is stored in the container box 14, and then the container box 14 is closed. In the front of the rechargeable main power source container 15, a control substrate configured to drive the light-emitting diode 12*b* and to regulate the power charging the power source 23 is provided.

As described above, since the charger 17 configured to charge the power source 23 of the toy boat 21 is provided on the electric motor toy transport trailer body 12, the power source 23 of the toy boat 21 can be charged with the electric motor toy transport trailer 11. Furthermore, since the charger 17 includes the rechargeable main power source 17*a* and the charging connector 17*c* connected to the rechargeable main power source 17*a* via the cord 17*b* and since the rechargeable main power source 17*a* is housed in the electric motor toy transport trailer body 12, the rechargeable main power source 17*a* can be provided on the electric motor toy transport trailer body 12 without changing the appearance of the electric motor toy transport trailer body 12.

Moreover, since the rechargeable main power source 17*a* is housed in the electric motor toy transport trailer body 12 in a manner such that the rechargeable main power source 17*a* is disposed at a position lower than the upper edge of the tires 13, the center of gravity is lowered and stability is increased. Accordingly, the toy boat 21 is prevented from turning over. Since the charging connector 17*c* is stored in the openable and closable container box 14 provided on the electric motor toy transport trailer body 12, the charging connector 17*c* can be stored in the container box 14 when not being used. As a result, the toy boat 21 has a simple figure.

Since the depression 22*c* is provided at the bottom of the toy boat 21 and since the plurality of protrusions 16 configured to support the toy boat 21 by entering the depression 22*c* of the toy boat 21 is provided on the cover 15*a* of the rechargeable main power source container 15 configured to store the rechargeable main power source 17*a* of the electric motor toy transport trailer body 12, the toy boat 21 can be loaded on the electric motor toy transport trailer 11 and transported in a stable manner.

Next, the toy boat 21 is described.

Figure 7:
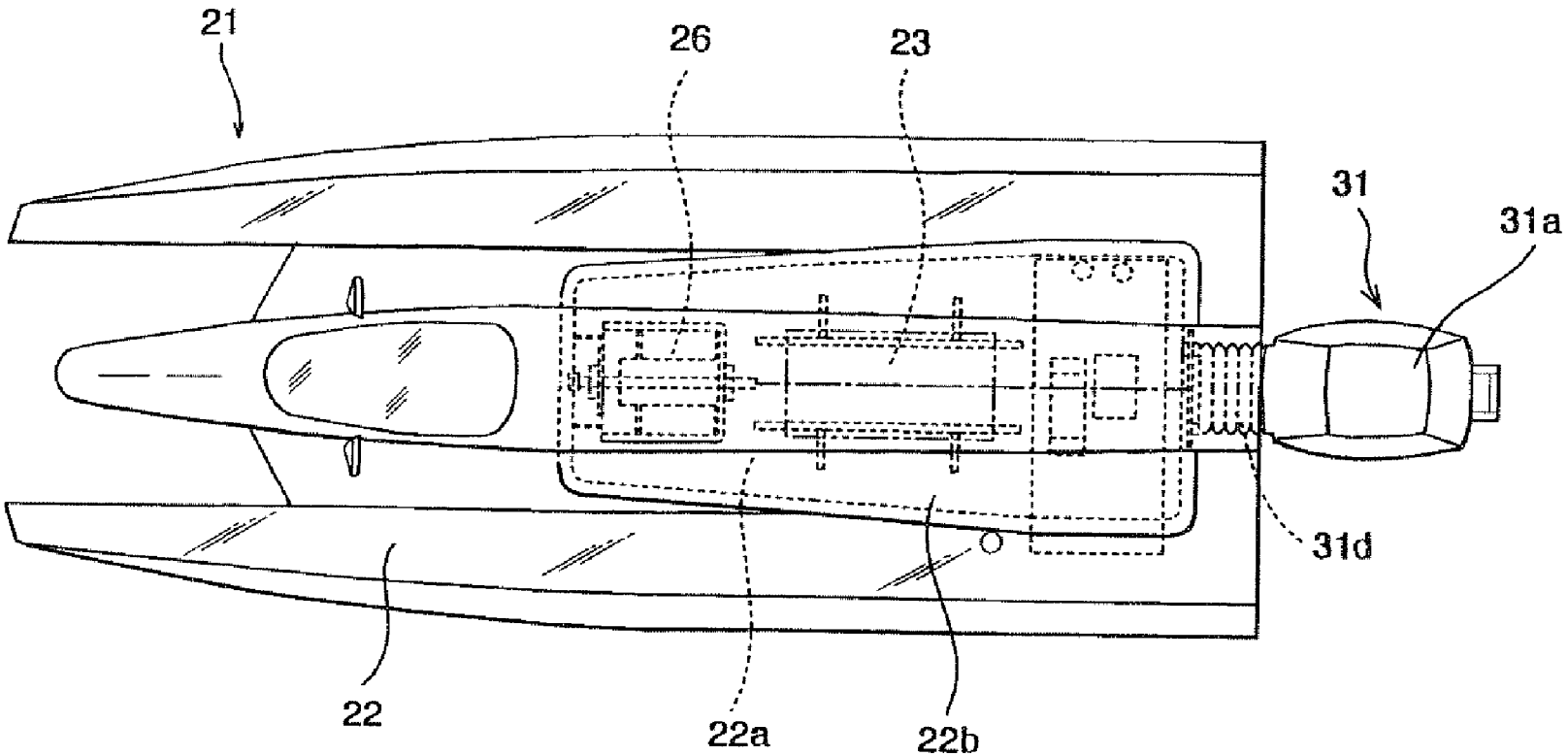
FIG. 7 is a plan view of the toy boat.
Figure 8:
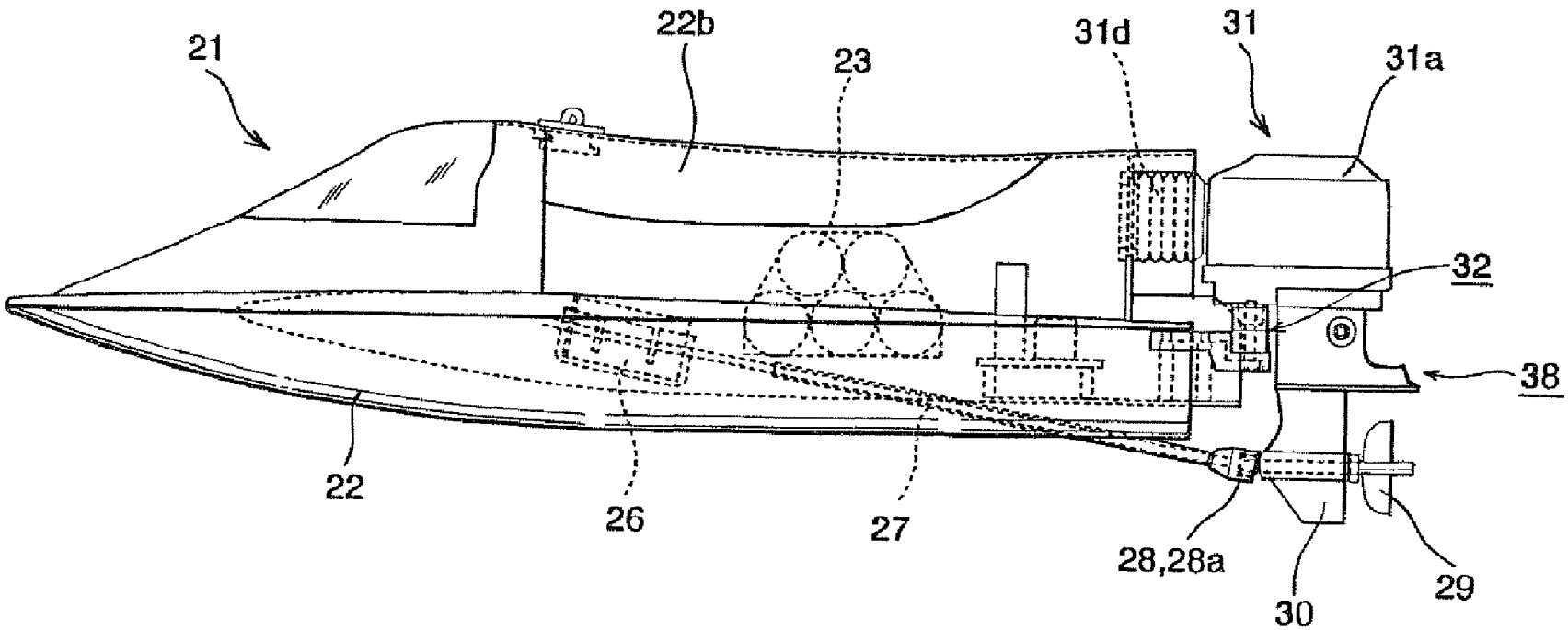
FIG. 8 is a side view of the toy boat.
Figure 9:
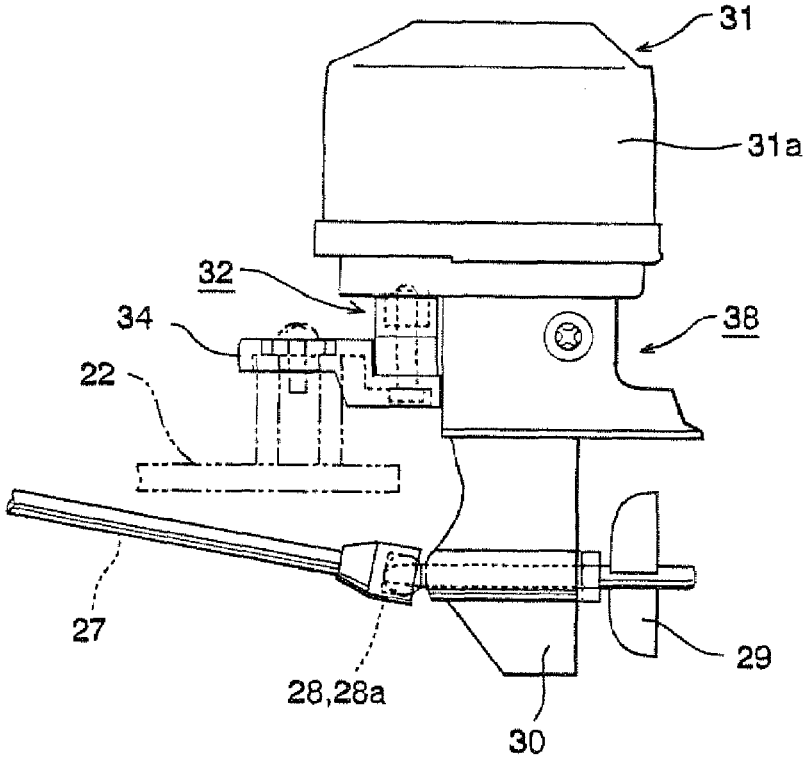
FIG. 9 is a side view of the servo mechanism and a screw in a mounted state.
Figure 10:
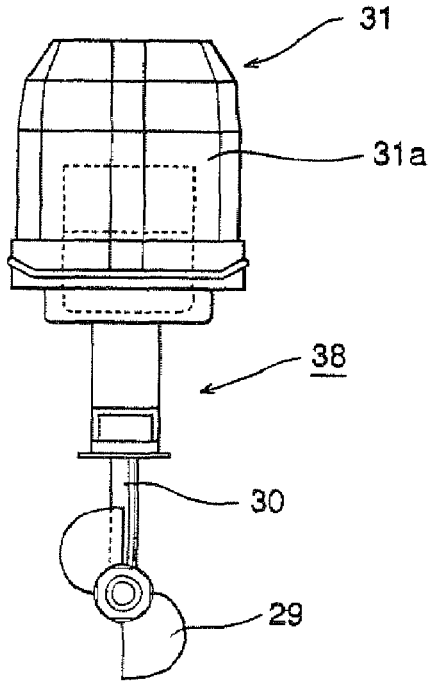
FIG. 10 is a back view of the servo mechanism and the screw in a mounted state.
Figure 11:
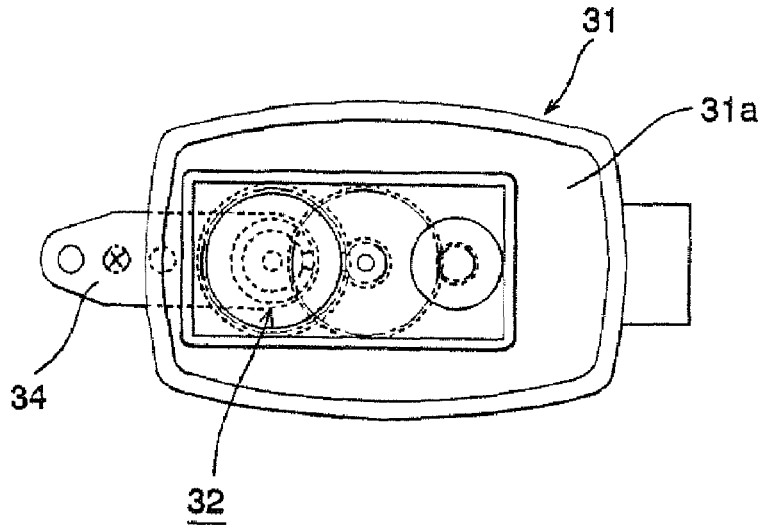
FIG. 11 is plan view illustrating the overall structure of the servo mechanism.
Figure 12:
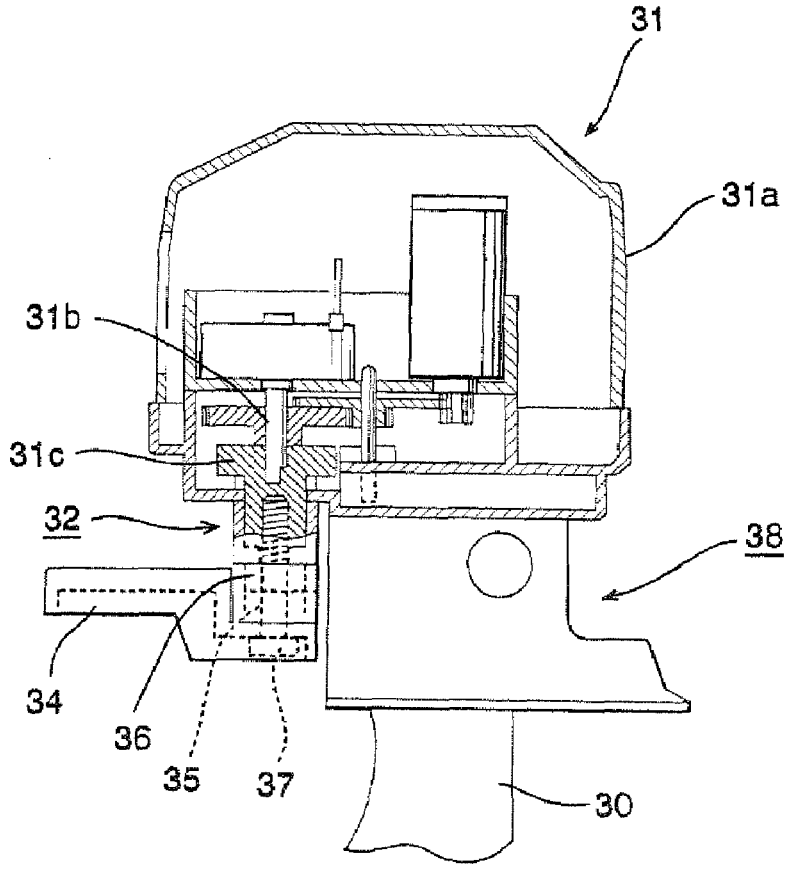
FIG. 12 is a longitudinal cross-sectional view of the servo mechanism.
Figure 13:
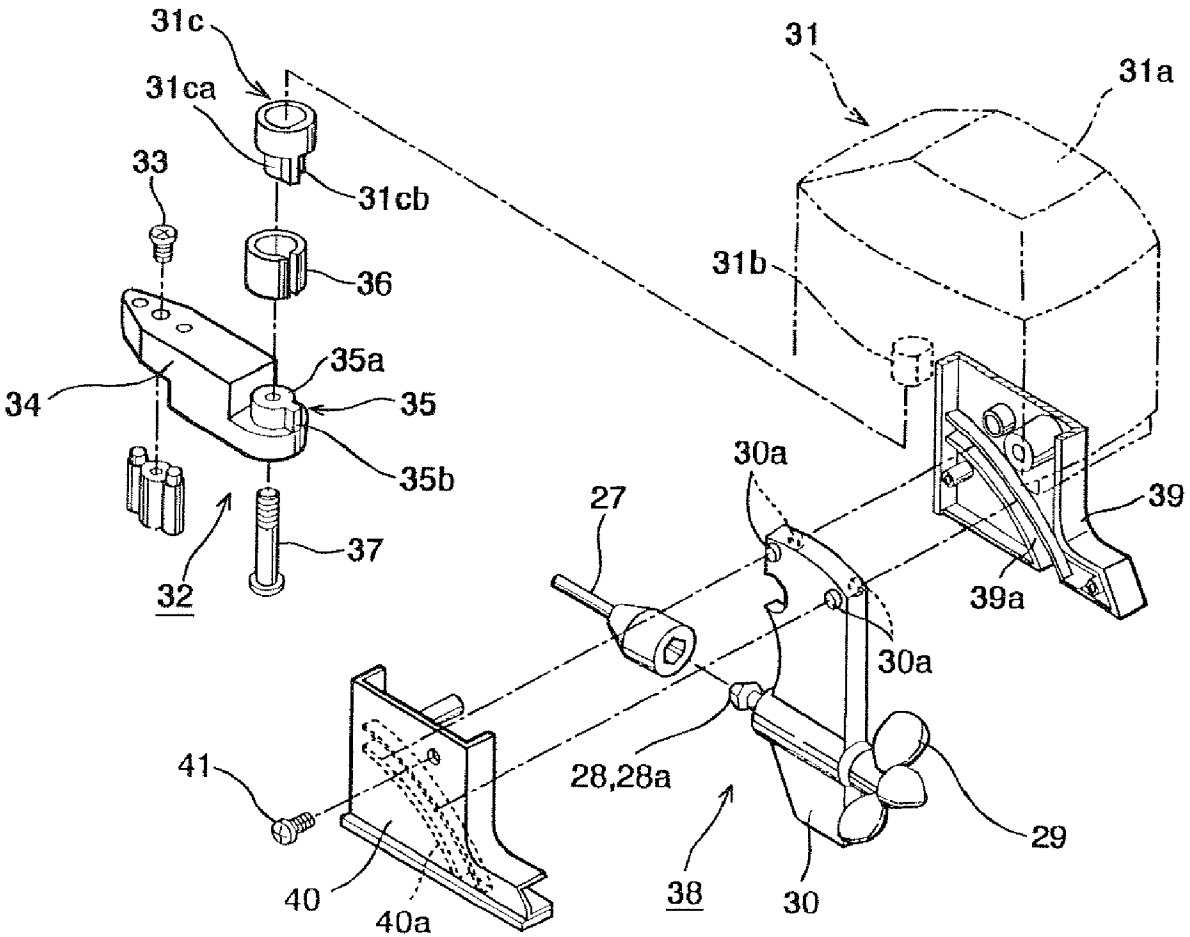
FIG. 13 is an exploded view illustrating the structure of an impact absorption mechanism and a screw-angle adjustment mechanism.
Figure 14:
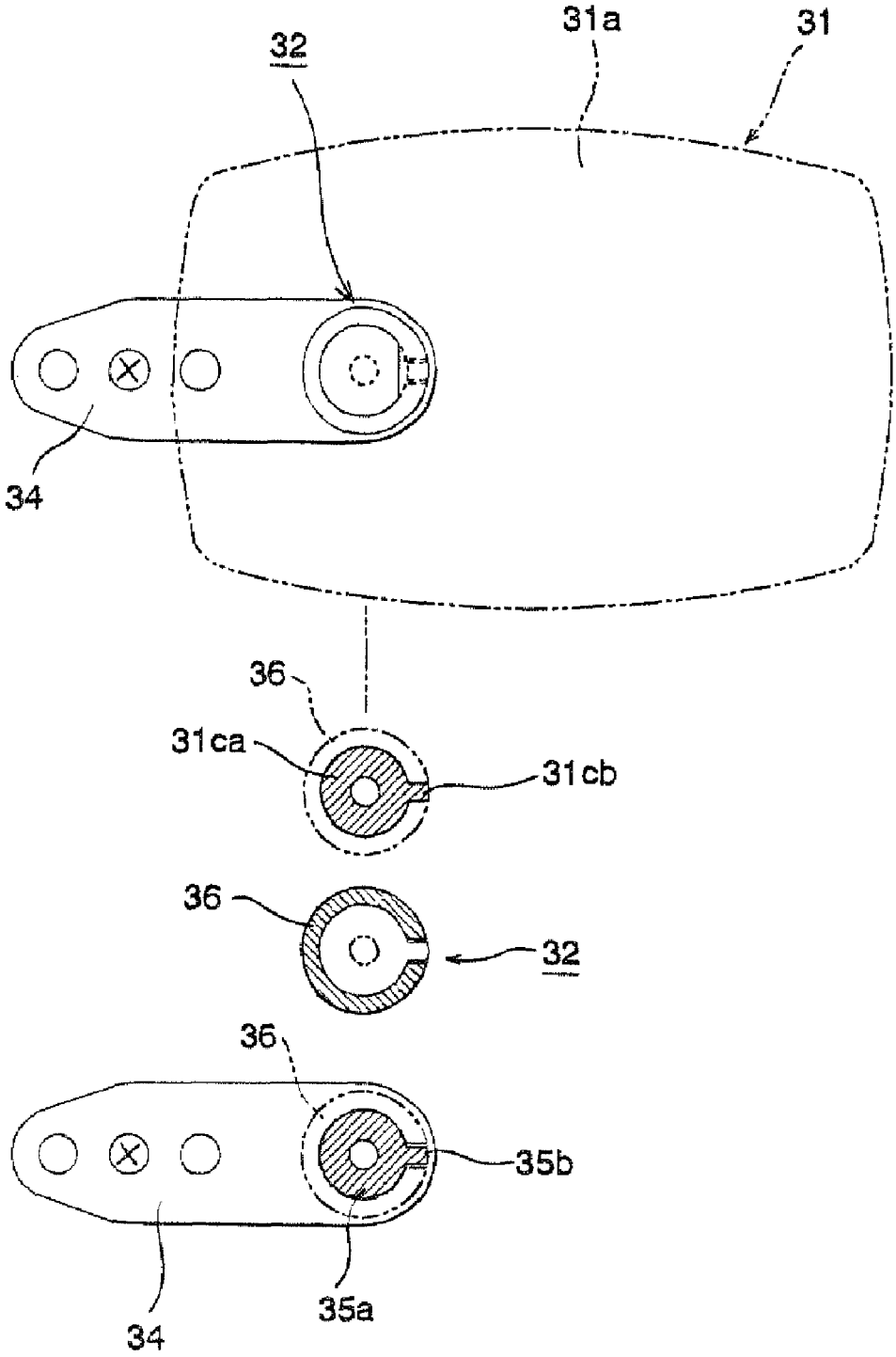
FIG. 14 is a schematic view illustrating the steering and the operation of the impact absorption mechanism.
Figure 15:
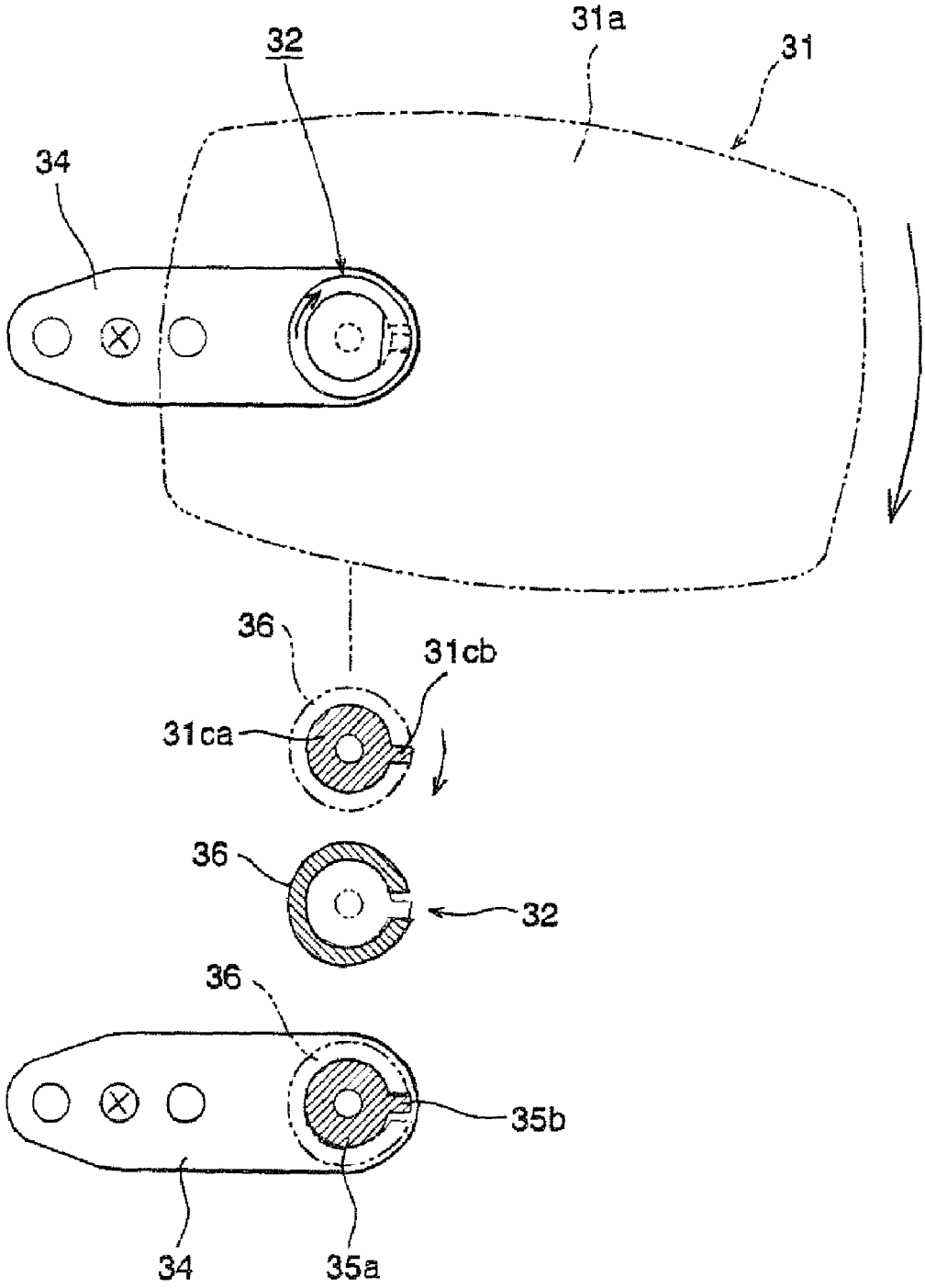
FIG. 15 is a schematic view illustrating the steering and the operation of the impact absorption mechanism.
Figure 16:
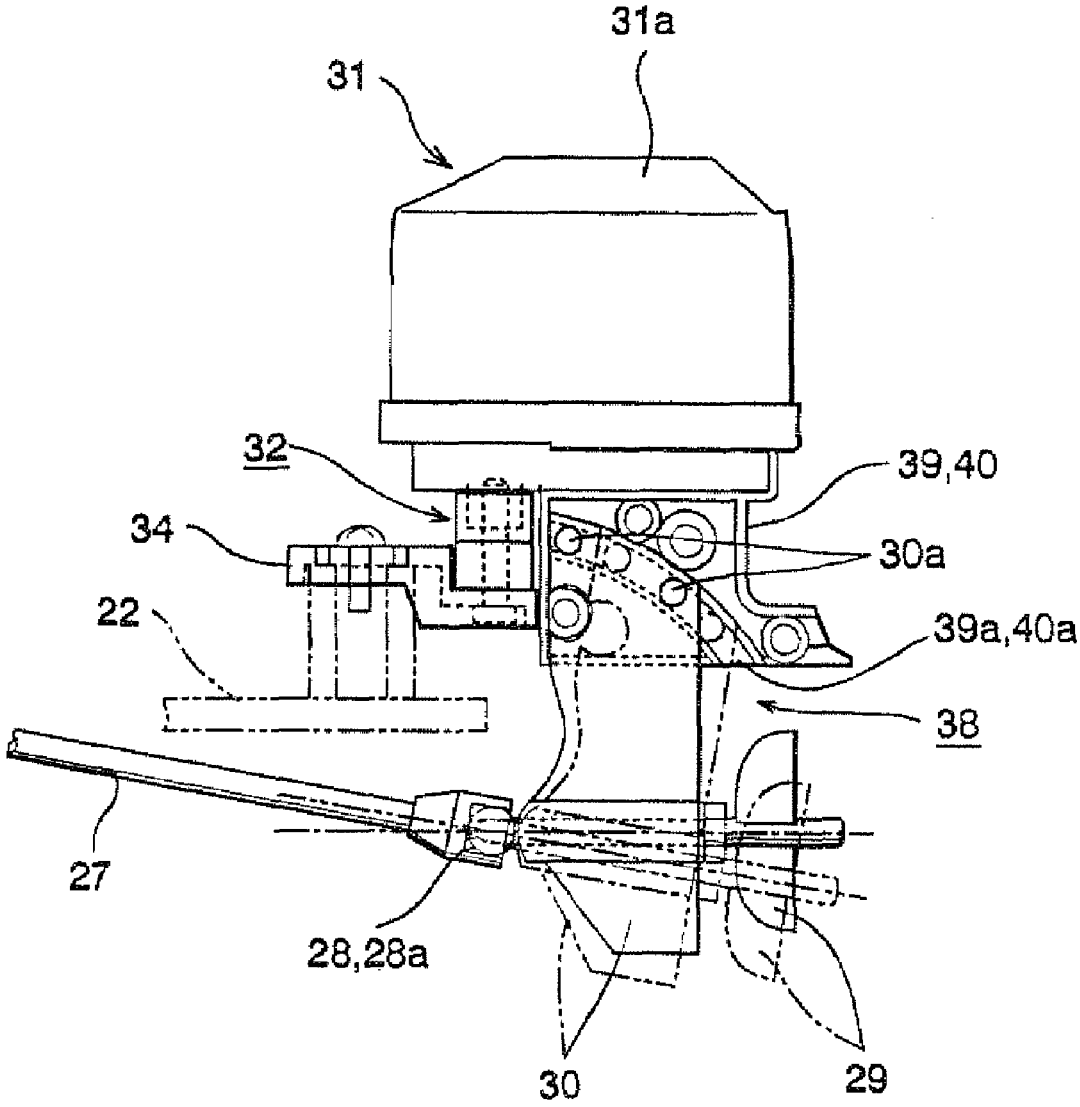
FIG. 16 is a schematic view illustrating the operation of the screw-angle adjustment mechanism.

FIG. 7 is a plan view of the toy boat. FIG. 8 is a side view of the toy boat. FIG. 9 is a side view of the servo mechanism and a screw in a mounted state. FIG. 10 is a back view of the servo mechanism and the screw in a mounted state. FIG. 11 is plan view illustrating the overall structure of the servo mechanism. FIG. 12 is a longitudinal cross-sectional view of the servo mechanism. FIG. 13 is an exploded view illustrating the structure of an impact absorption mechanism and a screw-angle adjustment mechanism. FIGS. 14 and 15 are schematic views illustrating the steering and the operation of the impact absorption mechanism. FIG. 16 is a schematic view illustrating the operation of the screw-angle adjustment mechanism.

As shown in the drawings, the toy boat 21 includes the boat body 22, the rechargeable power source 23 detachable from the boat body 22 and capable of supplying electric power to various components, an antenna 24 mounted on the boat body 22 and capable of receiving a control signal from the a controller not shown in the drawings, a controlling unit (not shown in the drawings) mounted on the inner side of the boat body 22 and capable of controlling the various components on the basis of a signal from the antenna 24, an electric motor 26 mounted on the inner side of the boat body 22 and controlled by the controlling unit, a driving shaft 27 having a first end attached to the rotary shaft of the electric motor 26 and a second end extending outside the boat body 22, a screw 29 connected to the second end of the driving shaft 27 located outside the boat body 22 with a hexagonal universal joint 28 having a hexagonal pyramid, a screw bracket 30 functioning as a rudder configured to rotatably support the screw 29, a servo mechanism 31 configured to turn the screw bracket 30 towards a horizontal position, an impact absorption mechanism 32 configured to mount the servo mechanism 31 on the outer side of the boat body 22 so that the servo mechanism 31 can be turned towards a horizontal position and to transmit power generated at the servo mechanism 31 to the screw bracket 30, and a screw angle and depth adjustment mechanism 38 (hereinafter simply referred to as a "screw adjustment mechanism 38") configured to adjust the screw angle and the screw depth. Also, a flexible pipe 31*d* is provided to cover the outer periphery of the cord used to connect the controlling unit (not shown) and the servo mechanism 31 and to prevent water from entering the servo mechanism 31.

The inner side of the boat body 22 is the container 22*a*. The container 22*a* stores various components. The opening of the container 22*a* is watertightly closed with the cover 22*b*.

At the bottom of the boat body 22, as shown in FIG. 3, the depression 22*c* penetrating through the boat body 22 in the longitudinal direction is provided.

On the left and right sides of the screw bracket 30, a plurality of (e.g., two) protrusions 30*a* is provided on a circle centered on a connecting part 28*a* of the driving shaft 27 and the hexagonal universal joint 28 in a manner such that, for example, pairs of the protrusions 30*a* are at same positions with respect to the circle.

Components, such as an electric motor and gears, are watertightly housed in a housing 31*a* of the servo mechanism 31, and signal lines from the boat body 22 are also sealed in a bellow-like sealed tube. The final stage transmission shaft 31*b*, as shown in FIG. 13, has a D-cut lower end. The D-cut portion is attached to a shaft end portion 31*c* having a protrusion 31*cb* protruding from the outer circumference of a circular cylinder 31*ca* along the shaft direction and being rotatable with the transmission shaft 31*b*.

The impact absorption mechanism 32, as shown in FIG. 13, includes a support shaft 35 being provided on the upper rear edge of a support member 34 mounted on the stern of the boat body 22 with a fixing screw 33 and having a protrusion 35*b* protruding from the outer circumference of a shaft 35*a* along the shaft direction, the shaft end portion 31*c* of the servo mechanism 31, an elastic C-ring member 36 holding the protrusions 31*cb* and 35*b* in a gap and embracing the circular cylinder 31*ca* and the shaft 35*a*, and an attachment screw 37 configured to fix the shaft end portion 31*c*, the support shaft 35, and the C-ring member 36 on the support member 34.

The screw adjustment mechanism 38, as shown in FIG. 13, includes a first fixing bracket 39 whose upper edge is attached to the housing 31*a* of the servo mechanism 31, a second fixing bracket 40 attached to the first fixing bracket 39 with a fixing screw 41, and the screw bracket 30 includes the protrusions 30*a* interposed and fixed between the first and second arc-shaped grooves 39*a* and 40*a*. The first fixing bracket 39 includes a first arc-shaped groove 39*a* being center around the connecting part 28*a*. The second fixing bracket 40 includes a second arc-shaped groove 40*a* being center around the connecting part 28*a* and opposing the first arc-shaped groove 39*a*. The screw bracket 30 can be moved in and along the first and second arc-shaped grooves 39*a* and 40*a*, wherein the movement is centered on the connecting part 28*a*.

The operation will now be described.

When a control signal from the controller is received at the antenna 24, the received control signal is supplied to the controlling unit, not shown in the drawings. The controlling unit that received the control signal in the above described manner controls the various units on the basis of the control signal.

Next, the control of the electric motor will be described.

When the controlling unit operates the electric motor 26, the toy boat 21 moves, and when the controlling unit stops the electric motor 26, the toy boat 21 stops moving. The speed of the toy boat 21 can be increased or decreased by increasing or decreasing the number of revolutions with the controlling unit. According to this embodiment, by storing the electric motor 26, whose weight is large, in the boat body 22, the center of gravity of the boat body 22 is lowered and, as a result, stable movement is achieved.

Next, the steering will be described.

To direct the toy boat 21 to move straight, the support shaft 35, the C-ring member 36, and the shaft end portion 31*c* included in the servo mechanism 31 and the impact absorption mechanism 32 are configured as shown in FIG. 14.

In this configuration, if the servo mechanism 31 is moved by a predetermined amount in order to turn the toy boat 21 leftwards, the servo mechanism 31 moves to the left (clockwise) relative to the impact absorption mechanism 32, as shown in FIG. 15, since the shaft end portion 31*c* is fixed to the support shaft 35 by the C-ring member 36.

In this way, when the servo mechanism 31 turns, the screw bracket 30 also turns toward the left (clockwise) relative to the impact absorption mechanism 32 since the screw bracket 30 is fixed to the housing 31*a* with the first and second fixing brackets 39 and 40. In this way, steering is possible.

While the toy boat 21 is moving in this way, if, for example, the right side of the screw bracket 30 contacts an obstacle, the screw bracket 30 turns further towards the left (clockwise). At this time, the C-ring member 36 elastically extends and absorbs the impact. After the absorption of the impact is completed, the C-ring member 36 elastically restores its original state.

Next, the adjustment of the angle and the depth of the screw will be described.

First, the fixing screw 41 is loosened and, as shown in FIG. 16, the screw bracket 30 is pivoted around the connecting part 28*a* along the vertical plane while the protrusions 30*a* is guided along the first and second arc-shaped grooves 39*a* and 40*a*. In this way, the screw 29 can be set at a predetermined angle. Then, the fixing screw 41 is tightened, and the protrusions 30*a* are interposed and fixed between the first and second brackets 39 and 40.

As described above, since the toy boat 21 according to the present invention may further include the impact absorption mechanism 32 configured to connect the boat body 22 and the servo mechanism 31, wherein the impact absorption mechanism 32 includes the support shaft 35 having the protrusion extending 35*b* from the outer circumference of a shaft part 35*a* along the shaft direction, wherein the support shaft 35 is mounted on the boat body 22, the shaft end portion 31*c* having the protrusion 31*cb* extending from the outer circumference of the circular cylinder 31*ca* along the shaft direction, wherein the shaft end portion 31*c* is attached to the transmission shaft 31*b* of the servo mechanism 31, and the elastic C-ring member 36 configured to dispose and hold the first and second protrusions 35*b* and 31*cb* in a gap and to embrace the shaft part 35*a* and the circular cylinder 31*ca*, even if the screw bracket 30 contacts an obstacle and receives an impact, the C-ring member 36 extends or contracts so as to absorb the impact. In this way, the servo mechanism 31 is prevented from being damaged.

Since the screw bracket 30 is fixed on the housing 31*a* of the servo mechanism 31, the screw bracket 30 can be directly turned towards a horizontal position by the servo mechanism 31. In this way, a rod configured to transmit power generated at the servo mechanism 31 to the screw bracket 30 for steering and to turn the screw bracket 30 towards a horizontal position is not required. Thus, steering can be adjusted easily.

The electric motor 26 is mounted to the inner side of the boat body 22, the screw 29 is connected to the driving shaft 27, which is driven by the electric motor 26, with the hexagonal universal joint 28 at the outside of the boat body 22, and the screw adjustment mechanism 38 configured to adjust the angle of the screw 29 by pivoting the screw 29 around the connecting part 28*a* connecting the hexagonal universal joint 28 and the driving shaft 27. Therefore, the screw bracket 30 can be turned while being centered around the connecting part 28*a* so as to finely and easily adjust the angle of the screw 29 in accordance with the wave condition and/or the size and type of the screw. Accordingly, the toy boat 21 can be steered in a manner suitable for various conditions.

The servo mechanism 31 is mounted on the outer side of the boat body 22 so that the screw bracket 30 can be turned towards a horizontal position, and the screw adjustment mechanism 38, as shown in FIG. 13, includes a first fixing bracket 39 whose upper edge is attached to the housing 31*a* of the servo mechanism 31, a second fixing bracket 40 attached to the first fixing bracket 39 with a fixing screw 41, and the screw bracket 30 includes the protrusions 30*a* interposed and fixed between the first and second arc-shaped grooves 39*a* and 40*a*. Moreover, the first fixing bracket 39 includes a first arc-shaped groove 39*a* being center around the connecting part 28*a*, the second fixing bracket 40 includes a second arc-shaped groove 40*a* being center around the connecting part 28*a* and opposing the first arc-shaped groove 39*a*, and the screw bracket 30 can be moved in and along the first and second arc-shaped grooves 39*a* and 40*a*, wherein the movement is centered around the connecting part 28*a*. Therefore, the screw bracket 30 can be turned towards a horizontal position by the servo mechanism 31 with the first and second fixing brackets 39 and 40. In this way, a rod configured to transmit power generated at the servo mechanism 31 to the screw bracket 30 for steering and to turn the screw bracket 30 towards a horizontal position is not required. Thus, the steering can be easily adjusted.

Since the plurality (e.g., two) of protrusions 20*a* is provided, the screw bracket 30 can be firmly fixed by the first and second fixing brackets 39 and 40. Since the universal joint is the hexagonal universal joint 28, the toy boat 21 having the above-described advantages may be provided at low cost.

The toy boat 21 transported by the electric motor toy transport trailer 11 according to the above-described embodiment is not limited and may be any electric motor toy, such as a toy automobile or a toy airplane.

In the above-described embodiment, the driving source directly rotates the screw bracket 30. However, the driving source may be mounted on the inner side of the boat body 22, and the servo mechanism may be mounted on the outer side of the boat body 22. In this way, the distance between the servo mechanism 31 and the screw bracket 30 is reduced, enabling the screw bracket 30 to be directly turned towards a horizontal position by the servo mechanism 31. Therefore, a rod configured to transmit power generated at the servo mechanism 31 to the screw bracket 30 for steering and to turn the screw bracket 30 towards a horizontal position is not be required.

In the above-described embodiment, the shaft end portion 31*c* is attached to the transmission shaft 31*b* of the servo mechanism 31. However, the edge of the transmission shaft 31*b* may be formed in the same manner as the shaft end portion 31*c*. In such a case, to gain the same advantages as those of the above-described embodiment, the screw adjustment mechanism may include a first fixing bracket (39), the second bracket (40), and the screw bracket (30), wherein the upper edge of the first fixing bracket (39) is mounted on the boat body 22 so that the first fixing bracket (39) can be turned towards a horizontal position, the first bracket (39) includes the first arc-shaped groove 39*a* centered around the connecting part 28*a*, the second bracket (40) includes the second arc-shaped groove 40*a*, which opposes the first arc-shaped groove 39*a* and is centered around the connecting part 28*a*, and is attached on the first bracket (39), the screw bracket (30) is centered around the connecting part 28*a* and is provided so that the screw bracket (30) is movable in and along the first and second arc-shaped grooves 39*a* and 40*a*, and the screw bracket (30) includes the protrusions 30*a* interposed and fixed between the first and second fixing brackets (39 and 40).

What is claimed is:

1. A toy boat comprising:

a boat body;

a driving source mounted on an inner side of the boat body, the driving source having a drive shaft which extends from one end thereof inside the boat body to an opposite end thereof outside the boat body;

a housing mounted on the outside of the boat body for turning movements between leftward and rightward positions relative to the boat body;

a screw bracket having an upper end connected to the housing for turning movements therewith;

a screw rotationally supported by a lower end of the screw bracket;

a connecting part having a universal joint outside the boat body which operably connects the opposite end of the drive shaft to the screw to allow the screw to be driven by the driving source so as to propel the boat body;

a servo mechanism housed within the housing and operably configured to turn the housing and the screw bracket mounted thereto between the leftward and rightward positions so as to positionally adjust the screw supported by the screw bracket and cause the boat body to turn leftward and rightward, respectively; and wherein a screw adjustment mechanism configured to adjust tilt angle and depth of the screw, wherein the adjustment mechanism is centered around the connection part, and wherein the screw adjustment mechanism includes, (i) first and second fixing brackets depending from the housing and defining a pair of opposed arc-shaped grooves wherein the upper end of the screw bracket is moveably interposed between the first and second fixing brackets;

(ii) at least one pair of protrusions extending outwardly from the upper end of the screw bracket and received respectively within the opposed arc-shaped grooves of the first and second fixing brackets, wherein (iii) movement of the protrusions within the arc-shaped grooves causes the screw bracket to pivot about the connection part so as to allow the screw bracket to be moved to a desired tilt angle position and thereby adjust the depth of the screw.

2. The toy boat according to claim 1, wherein the first fixing bracket has an upper edge which is fixed to the housing, and wherein the second fixing bracket is separably connected into the first fixing bracket, and wherein the screw adjustment mechanism further comprises a fixing screw to connect the second fixing bracket to the first fixing bracket in such a manner to allow the second fixing bracket to be separated from the first fixing bracket when the fixing screw is loosened, and to allow the second fixing bracket to be tightly connected to the first fixing bracket when the fixing screw is tightened, wherein (a) when the fixing screw is loosened, the first and second fixing brackets are separated from one another sufficently to allow the screw bracket to be moved manually to the desired tilt angle position due to the at least one pair of protrusions being moveable within the arc-shaped grooves, and wherein (b) when the fixing screw is tightened the first and second fixing brackets will immovably fix the protrusions within the arc-shaped grooves so as to maintain the desired tilt angle position.

3. The toy boat according to claim 1, wherein the screw bracket includes multiple pairs of protrusions.

4. The toy boat according to claim 2, wherein the screw bracket includes multiple pairs of protrusions.

5. The toy boat according to claim 1, wherein the servo mechanism includes an electric motor housed within the housing.

* * * * *